United States Patent [19]

Horbelt et al.

[11] 4,240,383

[45] Dec. 23, 1980

[54] FUEL METERING DEVICE FOR AN INTERNAL COMBUSTION ENGINE

[75] Inventors: Michael Horbelt, Schwieberdingen; Hans Schnürle, Walheim; Ulrich Drews, Vaihingen-Pulverdingen; Richard Bertsch, Asperg, all of Fed. Rep. of Germany

[73] Assignee: Robert Bosch GmbH, Stuttgart, Fed. Rep. of Germany

[21] Appl. No.: 23,508

[22] Filed: Mar. 23, 1979

[30] Foreign Application Priority Data

Apr. 4, 1978 [DE] Fed. Rep. of Germany ..... 2814397

[51] Int. Cl.[3] ..... F02D 5/02

[52] U.S. Cl. ..... 123/492; 123/491

[58] Field of Search ..... 123/32 EA, 32 EG, 32 EH, 123/32 EL, 32 EJ

[56] References Cited

U.S. PATENT DOCUMENTS

| | | | |
|---|---|---|---|
| 3,623,459 | 11/1971 | Gordon et al. | 123/32 EH |
| 3,683,871 | 8/1972 | Barr et al. | 123/32 EG |
| 3,759,231 | 9/1973 | Endo | 123/32 EH |
| 4,051,818 | 10/1977 | Volckers | 123/32 EJ |
| 4,153,014 | 5/1979 | Sweet | 123/32 EG X |
| 4,159,697 | 7/1979 | Sweet | 132/32 EH |

*Primary Examiner*—Tony M. Argenbright

*Attorney, Agent, or Firm*—Edwin E. Greigg

[57] ABSTRACT

A device for metering fuel in an internal combustion engine which comprises sensors for operating parameters, an acceleration detecting stage with a subsequently connected pulse generating stage as well as a pulse lengthening stage, and a fuel metering system wherein the acceleration detecting stage is indirectly and/or directly associated with at least one of a plurality of components including an oscillation stopper (to prevent renewed triggering in case of an oscillation-carrying input signal), a blocking stage (for unequivocal and secure triggering), a repetition stopper (to avoid multiple triggering during gradual and longer-term signal rises), and a switching suppressor (to prevent a voltage rise after a switching step from being evaluated as an instance of acceleration) so that the device serves to operate the acceleration enrichment of the fuel-air mixture for the internal combustion engine with a minimum of disturbance thereby attaining optimum acceleration processes.

10 Claims, 7 Drawing Figures a)

b)

| FUNCTIONAL GROUP | $\dot{U}_1, \dot{U}_1^*$ | $\dot{U}_2$ | $\dot{U}_3$ | $\dot{U}_4$ | $\dot{U}_5$ | $\dot{U}_6$ | $\dot{U}_7$ |
|---|---|---|---|---|---|---|---|
| ENRICHMENT (INTERMEDIATE INJECTION+ FACTOR) | ZS | | | | | | |
| BLOCKING STAGE • | ○ | | | | | | |
| OSCILLATION STOPPER | | x | | | x | x | |
| SWITCHING SUPPRESSOR • | | | ○ | x | | | |
| REPETITION STOPPER • | ○ | | | | | | x |
| STARTING SUPPRESSION | x | x | x | x | x | x | x |

○ SETTING OF THE COMPONENT x ≙ SUPPRESSION OF ZS

FUEL METERING DEVICE FOR AN INTERNAL COMBUSTION ENGINE

BACKGROUND OF THE INVENTION

The invention concerns a device for fuel metering in an internal combustion engine. A fuel injection system is known wherein the acceleration is detected through the opening of the throttle valve and/or by way of a reduction in the intake manifold vacuum and wherein an increase in the fuel supply is accomplished, on the one hand, by additional injection pulses and furthermore by a prolongation of the normal injection pulses.

In such prior art fuel injection systems, considerable problems have been encountered due to the fact that, in particular, the signal forming the basis for the recognition of the acceleration process is normally accompanied by interference. It is an object of this invention to provide a device for the gating or suppression of these interferences so that the acceleration process can take place in an optimum fashion.

OBJECT AND SUMMARY OF THE INVENTION

The device of this invention for metering fuel has the advantage that acceleration processes are clearly recognized and also the mixture enrichment during these acceleration processes takes place exactly and reliably. Thus, no acceleration processes are simulated, for example, even in case of increases in the operating voltage after voltage surges, e.g. when certain units are additionally connected to the system, and therefore no mixture enrichment steps are effected at unfavorable points in time.

It also proved to be expecially advantageous to select the intermediate injections provided at the beginning of an acceleration process so that they are dependent on as well as independent of the temperature.

Other objects and advantages of the present invention will be more readily apparent from a further consideration of the following detailed description of the drawings illustrating the preferred embodiments of the invention, in which;

DESCRIPTION OF THE EMBODIMENTS

Figure 1:
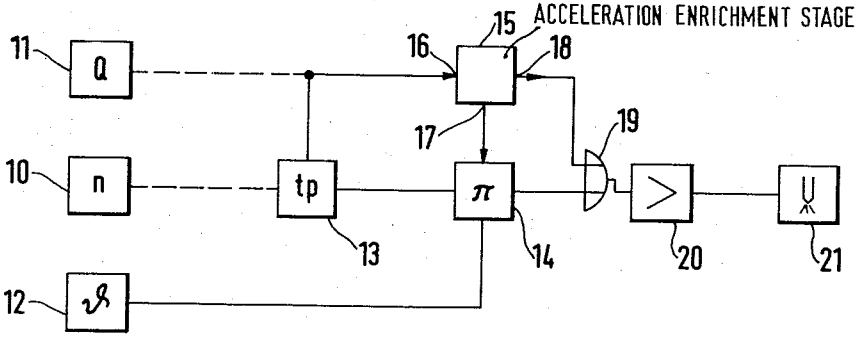
FIG. 1 is a block circuit diagram of a fuel injection system for internal combustion engines.

The invention relates to a device for fuel metering in conjunction with a fuel injection system in an internal combustion engine with external ignition. FIG. 1 shows the over-all structure of such an injection system, comprising three detecting elements including element 10 for the speed, element 11 for the amount of air throughflow and element 12 for the temperature. In a pulse generating stage 13, injection pulses having a length tp are formed, based on the output signals of the speed transducer 10 and the air volumeter 11; these injection pulses are corrected in accordance with the temperature in a subsequent correction stage 14. Reference numeral 15 denotes an acceleration enrichment stage. The input 16 of the acceleration enrichment stage 15 is connected to the air volumeter 11; a first output 17 is connected to the correction stage 14, and a second output 18 is connected to a first input of an OR gate 19. The second input of this OR gate 19 is coupled with the output of the correction stage 14. On the output side, the OR gate 19 is connected to a driver stage 20 for the electromagnetic injection valves 21.

In the arrangement of FIG. 1, the injection pulses of a length tp, formed in the pulse generating stage 13, are prolonged in the subsequent correction stage 14 in accordance with the temperature as well as the acceleration. The acceleration is detected by way of the output signal of the air volumeter 11, namely, in such a way that this output signal is differentiated and the extent of the change in the air volumeter output signal serves for controlling the acceleration enrichment stage 15. Depending on the degree of acceleration, the injection pulse having the length tp is changed in length by way of the correction stage 14. At the same time, the acceleration enrichment stage 15 transmits, at its output 18, a signal at the beginning of the acceleration process, this signal serving for the production of a so-called intermediate injection of the injection valves 21. The OR gate 19 couples the output signal of the correction stage 14 as well as the intermediate injection signal appearing at the output 18 of the acceleration enrichment stage 15 to the driver stage 20 for the injection valves 21.

Figure 2:
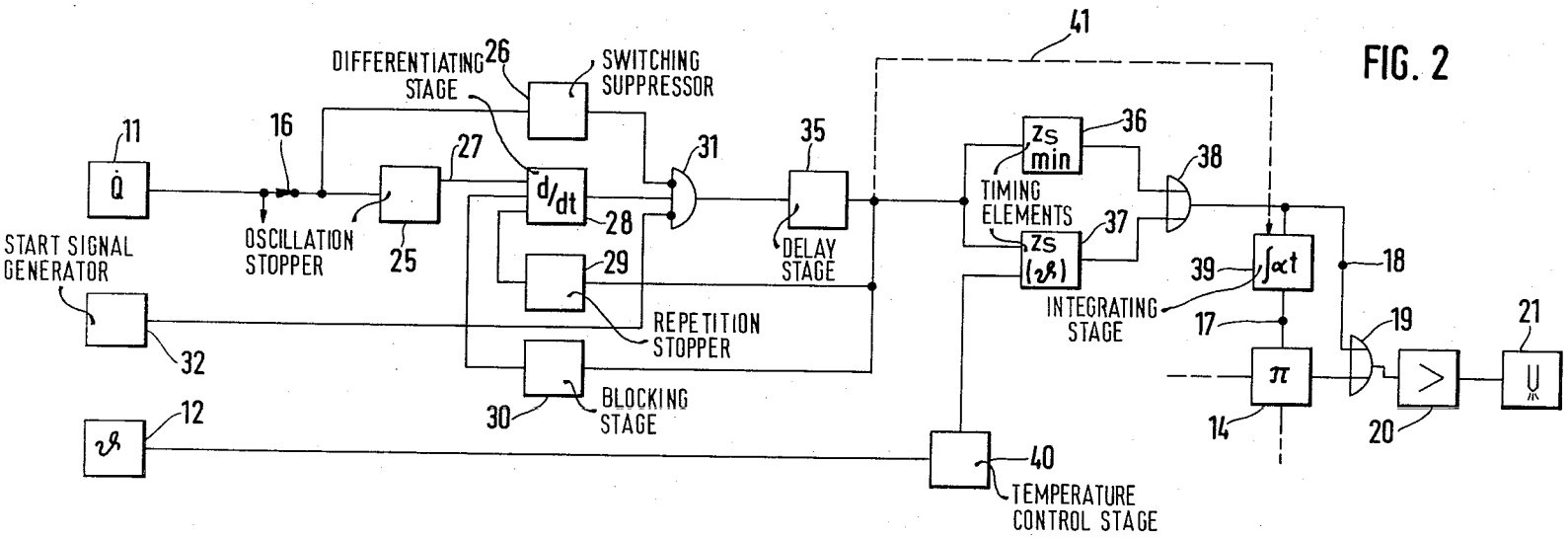
FIG. 2 is a block circuit diagram of the circuit arrangement responsible for acceleration enrichment.

FIG. 2 shows essentially the acceleration enrichment stage 15 of FIG. 1. The remaining boxes in FIG. 2, which coincide with those in FIG. 1, are provided with corresponding numerals. An oscillation stopper 25 as well as a switching suppressor 26 follow the input 16 of the acceleration enrichment stage 15. A line 27 leads from the output of the oscillation stopper 25 to a differentiating stage 28, which latter has additionally transmitted thereto input signals from a repetition stopper 29 and a blocking stage 30. An AND gate 31 with one non-inverting input and two inverting inputs follows the differentiating stage 28. The switching suppressor 26 as well as a start signal generator 32 are coupled to the inverting inputs of the AND gate 31. On the output side, the AND gate 31 is connected to a delay stage 35, the output of which is coupled with the repetition stopper 29 as well as with the blocking stage 30.

Furthermore, two timing elements 36, 37 for the generation of intermediate injections are connected to the output of the delay stage 35. The outputs of both timing elements 36 and 37 are connected to an OR gate 38, the output of which constitutes, in turn, the output 18 of the acceleration enrichment stage 15 and connects output 18 to an input of the OR gate 19. While the first timing element 36 yields a minimum intermediate injection of constant duration, the timing element 37 is also connected to a temperature control stage 40 and to the temperature detector 12, so that an intermediate injection can be produced which is dependent on the temperature with respect to its duration. A connecting line 41 from the output of the delay stage 35 to the integrating stage 39 is illustrated in dashed lines, permitting a control of the integrating stage 39 directly by the output signal of the delay stage 35.

Figure 3:
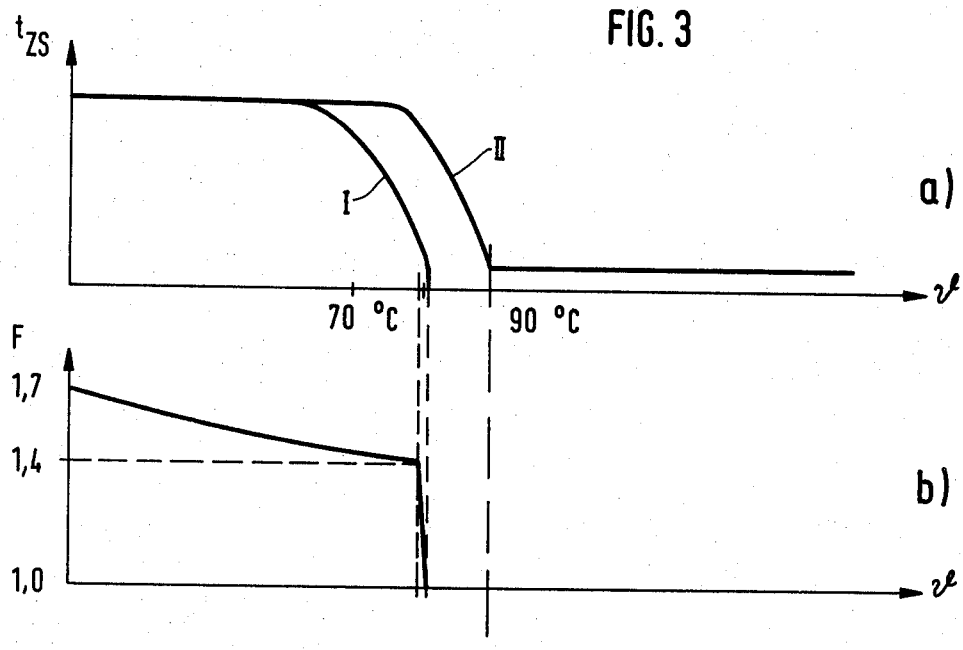
FIG. 3 shows two characteristic curves plotting the occurrence of intermediate injections as well as the enrichment factor during a pulse lengthening period over the temperature.
Figure 4:
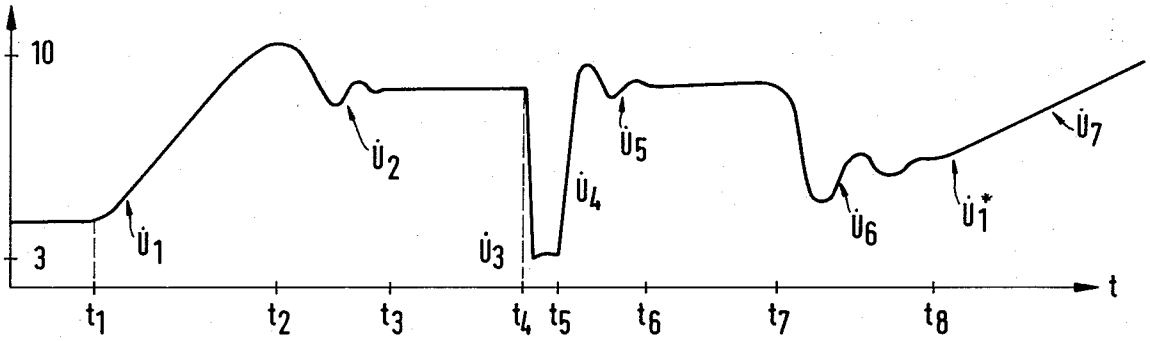
FIG. 4 shows the output signal of the air volumeter plotted over time and contains a table showing the activation of the individual function groups illustrated in FIG. 2.
Figure 5:
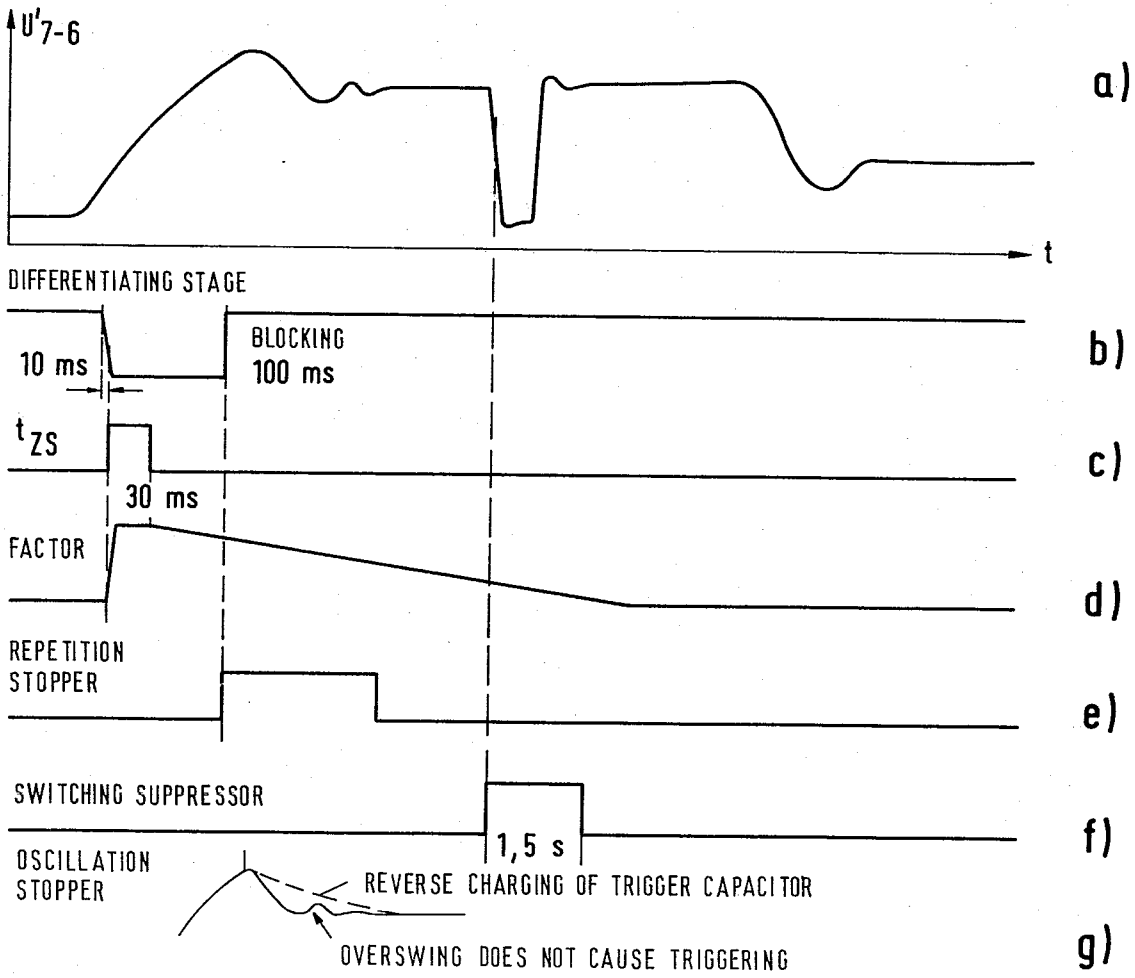
FIG. 5 shows several pulse diagrams in connection with the circuit arrangement of FIG. 2.

The mode of operation of the circuit arrangement depicted if FIG. 2 can be explained advantageously with reference to the curves shown in FIGS. 3, 4 and 5.

In FIG. 3, curve (a) clarifies the occurrence of intermediate injections in case of acceleration in accordance with the temperature. It can be seen that the duration of an intermediate injection denoted by $t_{ZS}$ has a uniform duration up to a temperature of about 50° C. and then drops in accordance with the temperature. In a first curve I, no intermediate injection occurs any longer starting with a temperature of the internal combustion engine of 80° C., whereas in the setting according to a second curve II, the duration of the intermediate injections remains constant up to a temperature of about 80° C. and thereafter is reduced in accordance with a selectable function. At about 90° C. the intermediate injections are cut off.

In FIG. 3, curve (b), the enrichment factor for the injection pulses is plotted in accordance with the temperature. The curve (b) shows that at the initial temperature the enrichment factor is 1.7, which then drops in accordance with the temperature and reaches the value 1.4 at about 80° C. At above this temperature, no mixture enrichment is conducted any longer in case of acceleration, since it is assumed that acceleration processes are problematic primarily at low temperatures, and that the normally set injection signals permit satisfactory acceleration at high, i.e., normal operating temperatures.

FIG. 4, curve (a), shows the output signal of the air volumeter 11 plotted over the time and for various operating conditions. FIG. 4 contains a table (b) showing the activation of the individual function groups illustrated in FIG. 2 in accordance with the respective output signal of the air volumeter 11. In the beginning, the air volumeter output signal has a relatively low value according to FIG. 4, curve (a). This value then rises at instant $t_1$ due to a corresponding movement of the throttle valve and reaches a maximum at instant $t_2$. This maximum value results due to an overswinging of the flap of the air volumeter 11 due to its inertia. A swing compensation process follows up to instant $t_3$, i.e., after this instant $t_3$, the position of the air volumeter flap assumes a stationary value. At instant $t_4$, the operator of the automotive vehicle initiates a switching procedure; the operator releases pressure on the accelerator pedal and thus, by way of a corresponding movement of the throttle valve, the output signal of the air volumeter 11 is likewise reduced. The reduction in the signal is again followed by a swing compensating process which, however, does not assume the magnitude of the swing compensating procedure in the vicinity of instant $t_2$. The reason for this is that the swinging process represents a percentage-type variable, and the output signal of the air volumeter 11 at instant $t_2$ is at a signal value of about 10 V and, at the time $t_5$, i.e., at the end of the switching step, is at a value of 3 V. After the time $t_5$ representing the end of the clutch operating step, the accelerator pedal is pressed downwardly again, and the air volumeter output signal rises once more due to the increased air flow, assuming at instant $t_6$ another stationary value. The instant $t_7$ marks the beginning of a temporally limited coasting operation, the accelerator pedal being first released and then, approximately at instant $t_8$, being depressed again, though gradually.

The illustration in FIG. 4, curve (a) clarifies the various operating conditions and thus the various output signals occurring at the air volumeter 11. Two desired acceleration processes can be seen, namely after instants $t_1$ and $t_8$. These acceleration processes can be derived from the change in the air volumeter output signal by differentiation. However, the derivation of the signal by itself is obviously insufficient for determining the acceleration processes, since, for example, in case of the swing compensating steps as well as after the end of a switching process, positive signal rises in the air flow output signal can likewise be detected. Here, one must ensure that the positive signal rises are not interpreted as desired acceleration steps and that no mixture enrichment takes place, either.

Various letter-number combinations $\dot{U}_1$ to $\dot{U}_7$ are associated with the curve (a) of FIG. 4. They mark important points at which the temporal derivations play an essential part for the further processing of the signals.

FIG. 4 shows a table (b) wherein the response of the individual groups depicted in FIG. 2 is plotted in association with the respective curve zones $\dot{U}_1$ through $\dot{U}_7$ illustrated in FIG. 4, curve (a). In this table, the symbol ZS represents the occurrence of an intermediate injection, a small circle denotes the setting of the individual component, and x stands for the suppression of an intermediate injection.

The instants at which the various components seen in FIG. 2 become operative can be derived from FIG. 5 in connection with the curve (a) of FIG. 4. After the occurrence of an acceleration signal at instant $t_1$, this acceleration signal is to be maintained with the aid of a holding circuit (blocking stage) so that the subsequent stages, such as the intermediate injection stage and the enrichment stage are safely triggered.

To avoid the interpretation of positive signal rises in the output signal of the air volumeter 11 after the actual acceleration as a desired acceleration step, an oscillation stopper is provided. The effect of this oscillation stopper resides in an obliteration of the swinging process, i.e., in permitting a gradual fading of this process, as illustrated in the last curve of FIG. 5. Thereby the positive ascending flanks of the swinging process are overridden and no new acceleration process is signaled.

The rises in the air volumeter output signal occurring after a switching step are suppressed by means of a switching suppressor. This is accomplished by the feature that a strong negative signal flank such as, for example, after instant $t_4$ of the signal in curve (a) of FIG. 4, triggers a timing element, and the output signal of this timing element prevents the production of an intermediate injection as well as of a pulse lengthening signal.

The behavior of the acceleration enrichment stage at the curve sections denoted by $\dot{U}_2$, $\dot{U}_5$, and $\dot{U}_6$ is identical and is determined by the effect of the oscillation stopper, i.e., the swinging processes are smoothed out.

The gradual signal rise in the zone of $\dot{U}_7$ explains the necessity of providing a repetition stopper. It is not intended during these gradual acceleration phases to trigger repeatedly intermediate injections and additionally enrich the mixture.

On the basis of the above described actions of the various components shown in FIG. 2, these components must transmit electrical signals in accordance with the diagrams of FIG. 5.

Curve (a) in FIG. 5 again shows the curve (a) of FIG. 4 on a rough scale and somewhat simplified. Curve (b) of FIG. 5 shows the pulse transmission of the blocking stage 30 of FIG. 2; Curve (c) of FIG. 5 shows the occurrence of an intermediate injection of timing elements 36 and/or 37; Curve (d) of FIG. 5 shows the temporally dependent enrichment factor fed to the correction stage 14 of FIG. 2. Curve (e) of FIG. 5 shows the output signal of the repetition stopper 29, the output signal of which joins that of the blocking stage 30 and, in the present case, also covers the time period of the oscillation process. In curve (f) of FIG. 5, the output signal of the switching suppressor is illustrated, and it can be seen that the time period of the switching suppressor signal is longer than the time period of a normally occurring switching process. Curve (g) of FIG. 5 indicates the operation of the oscillation stopper 25 illustrating by means of a dashed line the obliteration of the oscillation process (of the signal to be evaluated for the acceleration enrichment).

Figure 6:
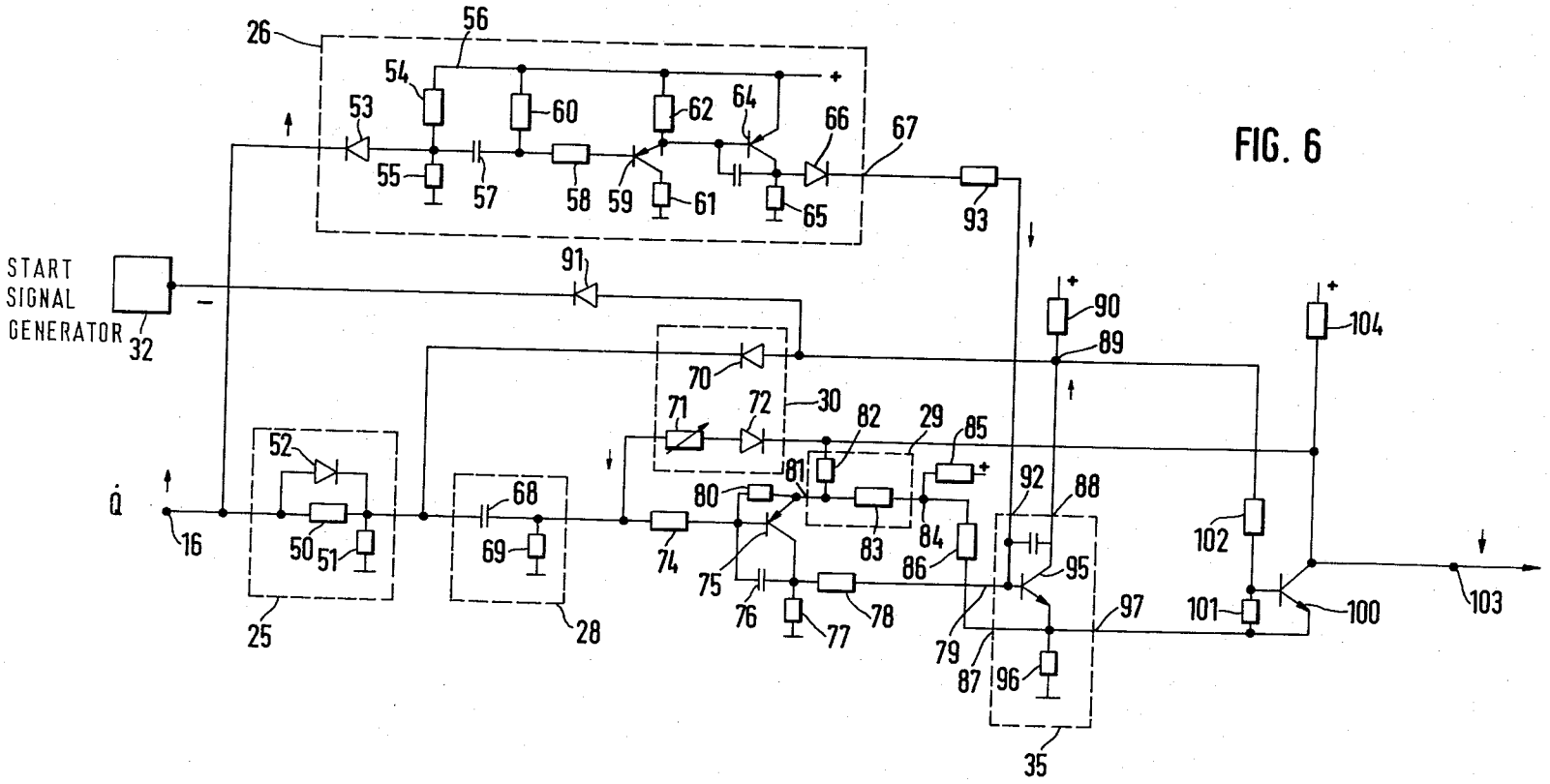
FIG. 6 shows in detail the circuit arrangement for a portion of the block circuit diagram of FIG. 2.
Figure 7:
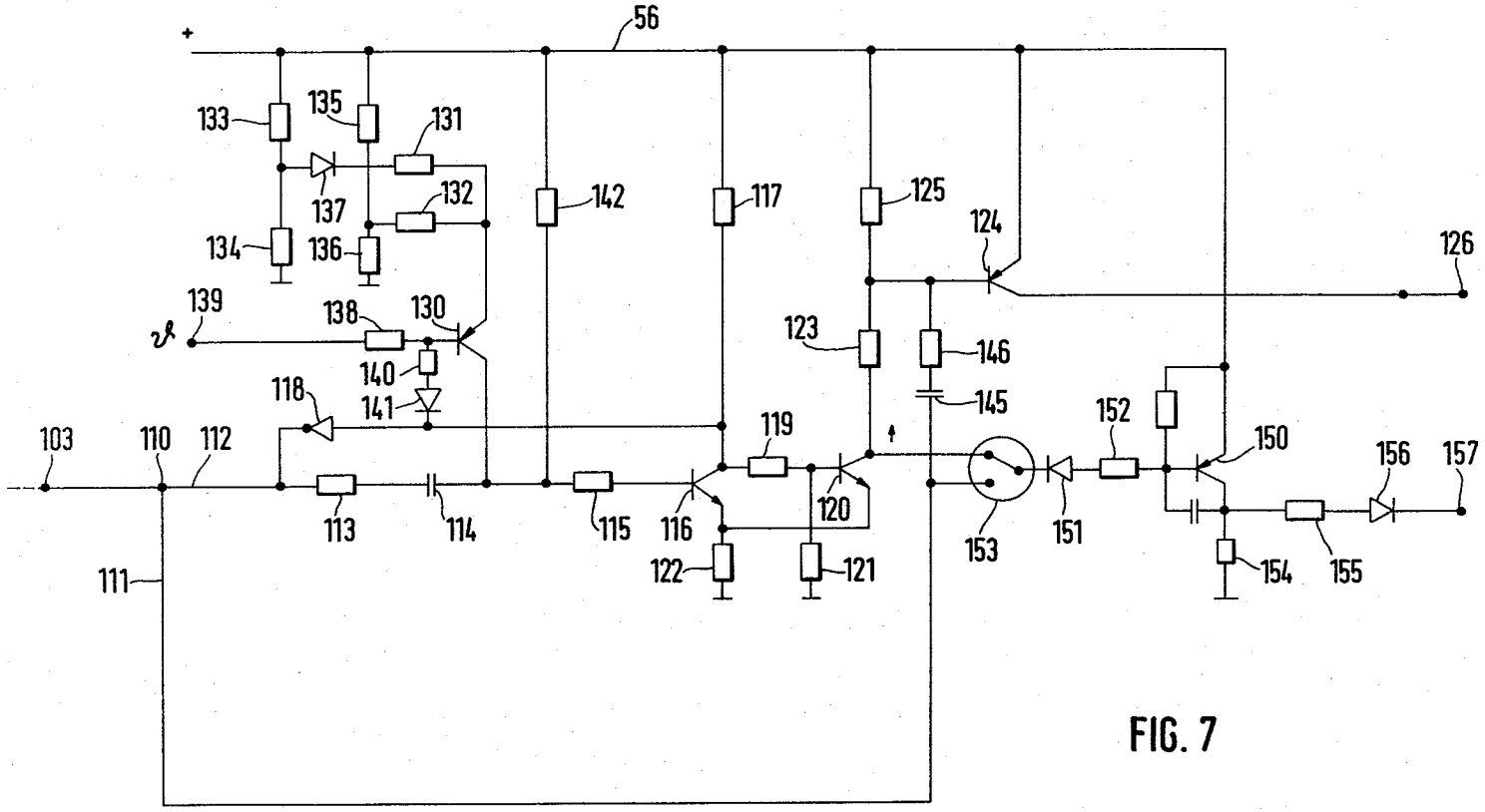
FIG. 7 shows in detail the circuit arrangement for another portion of the block circuit diagram of FIG. 2.

One embodiment for the circuit arrangement depicted in FIG. 2 is shown in FIGS. 6 and 7. In this connection, the circuit arrangement of FIG. 6 encompasses the left-hand part of the circuit of FIG. 2, including the delay stage 35 with the return lines to the repetition stopper 29 and to the blocking stage 30. FIG. 7 shows the right-hand part of the circuit arrangement of FIG. 2 with the timing elements 36 and 37, as well as the integrating stage 39.

In the circuit arrangement of FIG. 6, the input 16 of the acceleration enrichment stage 15 of FIG. 1 is linked to the oscillation stopper 25 and the switching suppressor 26.

The oscillation stopper 25 consists of a voltage divider made up of two resistors 50 and 51 between the input 16 and a ground conductor, not shown in detail, wherein the input resistor 50 is bridged by a diode 52 connected in the conductive direction for positive voltages applied thereto. A diode 53 follows an input of the switching suppressor 26, and the diode 53 is followed by the junction point of two resistors 54 and 55 between a positive line 56 and ground. This junction point is additionally connected via a capacitor 57 and a resistor 58 to the base of a transistor 59. The junction point of capacitor 57 and resistor 58 is additionally coupled through a resistor 60 to the positive line 56. The collector of the transistor 59 is connected to ground through a resistor 61; the emitter is connected to the positive line 56 by way of a resistor 62. Additionally, the emitter of this transistor 59 is connected to the base of a further transistor 64, which transistor 64 operates as an integrator by the use of a capacitor between the base and the collector. The emitter of transistor 64 is coupled directly to the positive line 56, and its collector is connected, on the one hand, through a resistor 65 to ground and, on the other hand, through a diode 66 to an output 67 of the switching suppressor 26.

The oscillation stopper 25 is followed, on the one hand, by the differentiating stage 28, consisting of a capacitor 68 and a resistor 69, which resistor 69 is connected to ground, and the stopper 25 is followed by a diode 70 of the blocking stage 30, wherein the direction of effectiveness of the blocking stage is in the direction toward the differentiating stage 28. The blocking stage 30 also includes a series circuit of a resistor 71 and a diode 72, which are coupled to the output of the differentiating stage 28.

A resistor 74 leads from the output of the differentiating stage 28 to the base of a transistor 75, the base and collector of which are connected by a capacitor 76, and the collector is connected through a resistor 77 to ground and also through a resistor 78 to a first input 79 of the delay stage 35. The emitter of transistor 75 is connected with the base of the transistor through a resistor 80. The emitter of the transistor 75 is connected with an input 81 of the repetition stopper 29, wherein this input 81 is connected through a resistor 82 to the cathode of diode 72 of the blocking stage 30 and through a resistor 83 to a junction point 84. From this junction point 84, a resistor 85 is connected to the positive line and the junction point 84 is connected to a second input 87 of the delay stage 34 through a resistor 86. A further input 88 of the delay stage 35 is coupled to a junction point 89 which is connected, in turn, through a resistor 90 to the positive line, to the anode of diode 70 of the blocking stage 30 and finally through a diode 91 to the start signal generator 32. A fourth input 92 of the delay stage 35 finally is coupled through a resistor 93 to the output 67 of the switching suppressor 26.

The delay stage 35 consists of a transistor 95 connected as an integrator, wherein the emitter is connected with point 87, the base is connected with inputs 79 and 92, and the collector is connected with input 88. The emitter of transistor 95 is also connected to ground through a resistor 96.

The point 87 of the delay stage 35 forms an output 97 on the right-hand side, connected to the emitter of a transistor 100. The base of this transistor 100 is connected, on the one hand, through a resistor 101 to the emitter of this transistor 100 and also through a resistor 102 to the junction point 89. A point 103 connected to the collector of the transistor 100 constitutes the output of the circuit arrangement shown in FIG. 6, this point 103 being additionally connected to the positive line through a resistor 104 and being finally connected to the junction point of diode 72 of the blocking stage 30 and resistor 82 of the repetition stopper 29.

Essentially the circuit arrangement according to FIG. 6 consists of the groups of components illustrated in FIG. 2. The important aspect in connection with the oscillation stopper 25 is that the time constant for reversing the charge of the trigger capacitor 68 is placed, in the subsequent differentiating stage 28, at a correspondingly high value depending on the charge reversal direction, which is accomplished by means of diode 52 in conjunction with resistor 50.

To avoid multiple triggering in case of gradual and longer-term signal rises (see, for example, the zone starting with $t_8$ in curve (a) of FIG. 4), the capacitor 68 of the differentiating stage 28 is reversed in its charge in a defined manner during the first triggering, so that a blockage period arises which must elapse before the next triggering can take place. This time period is determined by the two resistors 82 and 83 in the repetition stopper 29.

The blocking stage 30 serves for ensuring a secure triggering of the intermediate injections. For this purpose, it is necessary to maintain the initial condition of the differentiating stage 28 for a minimum period of time, wherein this time period can be adjusted by means of resistor 71 and in cooperation with diodes 70 and 72.

The switching suppressor 26 serves to prevent the voltage rise of the air volumeter output signal after a switching step being evaluated as an acceleration signal. For this reason, the reduction in the level of the air volumeter output signal at the beginning of a switching step is evaluated for triggering a timing element, and for a predetermined period of time a possibly occurring acceleration signal is suppressed.

In detail, the circuit arrangement shown in FIG. 6 functions as follows:

If a positive voltage rise occurs at the input 16 of the circuit arrangement, then this voltage rise is transmitted through the diode 52 of the oscillation stopper 25 to the differentiating stage 28. In case of an initial positive voltage rise, the oscillation stopper 25 thus does not become operative, since it is, so to speak, bridged by the diode 52. The differentiating stage 28 transmits the positive voltage rise of the input signal to the base of transistor 75, which transistor becomes thereby nonconductive, and thus the collector potential of this transistor is in the direction toward ground.

Consequently, the base potential of the subsequent transistor 95 is likewise reduced, which thereby also becomes nonconductive. This means that transistor 100 becomes conductive and thus a voltage surge occurs on the collector side of this transistor and therefore also at the output point 103. If, in case of a positive voltage rise at the input 16 of the circuit arrangement, the transistor 95 becomes nonconductive, then the potential at junction point 89 also rises on the collector side of this transistor. This rise is fed back through the diode 70 of the blocking stage 30 to the input of the differentiating stage 28.

A lowering of the collector voltage of transistor 100 also effects a reduction in the emitter voltage of transistor 75. Therefore, this transistor 75 is controlled, in addition to the normal control signal, in accordance with the output signal of transistor 100 by way of the resistor 82 contained in the repetition stopper 29. Also, the base potential and, through the capacitor 76, the emitter potential of transistor 75 are lowered. Thus, a positive feedback effect is obtained for the signal at the output 103 along the lines of a repetition stopper.

During startup, the start control stage 32 transmits a zero or negative signal, which also lowers the potential at junction point 89 through the diode 91. As a consequence, the transistor 100 becomes nonconductive, which, in turn, has the result that no (negative) control signal is possible for the subsequent pulse generating stages.

In switching suppressor 26, a negative input voltage jump results in rendering transistor 59 and also transistor 64 conductive. As a result, the voltage rises at the output 67 of the switching suppressor 26, and the transistor 95 becomes conductive. This, in turn, entails a blocking of transistor 100, and, for this reason, due to the presently appearing positive signal, an acceleration enrichment is not carried out at output 103. This lasts for a period of time determined by the behavior of the integrator with the transistor 64 of the switching suppressor 26.

FIG. 7 shows a detailed circuit diagram of the timing elements 36 and 37 of the circuit arrangement of FIG. 2 with the associated circuitry. In this connection, the output 103 of FIG. 6 is identical to input 103 of FIG. 7. There follows a branching point 110, the first branch line 111 of which leads to the timing element 36, and the second branch line 112 of which leads to the timing element 37 of FIG. 2. The line 112 is followed by a resistor 113, a capacitor 114, a resistor 115 and the base of a transistor 116. The collector of this transistor 116 is connected through a resistor 117 to the positive line 56 and is fed back through an inverter 118 to the input line 112. Also, the collector of this transistor 116 is connected through a resistor 119 to the base of a further transistor 120 and through a resistor 121 to ground. The emitters of both transistors 116 and 120 are coupled together and connected to ground via a resistor 122. The collector of transistor 120 is connected through a resistor 123 with the base of a transistor 124, which base, in turn, is connected to the positive line 56 through a resistor 125. While the emitter of transistor 124 is connected directly to the positive line 56, its collector is connected to the output 126 of the circuit arrangement and yields at this point intermediate injection signals in case of acceleration.

The duration of the intermediate injection steps provided by way of the transistor 116 and 120 is determined by the emitter-collector current through a transistor 130. On the emitter side, this transistor 130 is connected through each of two resistors 131 and 132 to two voltage dividers, consisting of the resistors 133–136, wherein the voltage divider for the lower delivery voltage additionally includes a diode 137 in the delivery circuit. The base of this transistor 130 is connected through a resistor 138 to an input 139, to which a temperature-dependent voltage is applied. In addition, the base of transistor 130 is connected through a series circuit made up of a resistor 140 and a diode 141 to the collector of transistor 116 (positive feedback). The collector of transistor 130 is connected to the junction point of capacitor 114 and resistor 115 and to the positive line 56 through a resistor 142.

A voltage drop at the input 103 of the circuit arrangement according to FIG. 7 results in blockage of transistor 116 which, in turn, causes the subsequent transistor 120 to become conductive. Thereby the transistor 124 likewise becomes conductive, and a positive signal appears at the output 126. The time period of applying the potential at output 126 is determined by the charge reversing time of capacitor 114. In this connection, an important factor is the current flow through transistor 130, which transistor is controlled in accordance with the temperature so that the duration of the intermediate injection steps can also be made dependent on the temperature. It proved to be expedient to produce the emitter voltage of this transistor 130 by way of different voltage dividers so that a nonlinear current characteristic is obtained for transistor 130.

The positive feedback of transistor 116 by way of the inverter 118 serves for a definite triggering of this transistor.

The timing element for minimum intermediate injection pulses denoted by 36 in FIG. 2 is accomplished by the series circuit of capacitor 145 and resistor 146, which series circuit is connected in line 111, starting with the junction point 110 and leads to the base of transistor 124. A negative voltage jump at input 103 of the circuit arrangement of FIG. 7 is tranmitted by this RC member to the base of transistor 124 and renders transistor 124 conductive, whereby a positive signal is produced at output 126. The duration of this signal is determined by the dimensioning of the RC member (145, 146) unless the temperature-dependent signal dominates through transistors 116 and 120.

The integrating stage 39 for the enrichment factor shown in FIG. 2 contains, according to FIG. 7, a transistor 150 connected as an integrator. This transistor 150 is controlled through a diode 151 and a resistor 152 by a double-throw switch 153 which switch is capable of switching the output signal of transistor 120 of the potential on line 111 to the base of transistor 150. While the emitter of this transistor 150 is connected directly to the positive line 56 or to the point 139 ($\theta$), its collector is connected to ground through a resistor 154 and through a series circuit of resistor 155 and diode 156, to an output 157 to which a signal is applied with respect to the enrichment factor. The double-throw switch 153 indicates the possibility of connecting the base of transistor 150, for example, by way of wire bridges, to varying potentials.

The timing elements 36 and 37 shown in FIG. 2 as a block circuit diagram and depicted in detail in FIG. 7 serve, as mentioned above, for producing an intermediate injection signal which is dependent on the temperature and an intermediate injection signal which is independent of the temperature. When the internal combustion engine has warmed up, no temperature-dependent intermediate injections are produced any longer. It is assumed that when the internal combustion engine has warmed up during operation, the pulse generator stage 13 of FIG. 1 already yields a sufficiently accurage mixture signal, so that only a brief intermediate injection tep is utilized which is formed with the aid of the timing element 36, i.e., with the RC member 145, 146.

The start signal generator 32 of FIG. 2, as well as FIG. 6, is for preventing the production of intermediate injection steps only directly during the actuation of the starter. Shortly after startup, the acceleration enrichment can likewise be activated, since the acceleration enrichment is triggered by the deflection of the air volumeter caused during speeding up of the internal combustion engine. The resulting enrichment, fading with the course of time, leads to an improved running of the internal combustion engine also during the phase after the startup.

What is claimed and desired to be secured by Letters Patent of the United States is:

1. A device for metering fuel in an internal combustion engine having semsors for detecting operating parameters and a fuel metering system comprising a sensor element for the amount of air throughflow of an internal combustion engine, an oscillation stopper circuit responsive to said sensor element and having an output, a switching suppressor responsive to said sensor element and having an output, a repetition stopper and a blocking stage each having an input and an output, an acceleration detection stage including a differentiating stage and responsive to the outputs of said oscillation stopper, said repetition stopper and said blocking stage, and an AND gate having inputs responsive to outputs of said switching suppressor and said acceleration detection stage and having an output directed to a fuel metering system.

2. A device according to claim 1 wherein said oscillation stopper comprises at least one diode.

3. A device according to claim 1 wherein said blocking stage includes positive feedback means and wherein said blocking stage is adapted to become effective after acceleration has been detected by said acceleration detecting stage.

4. A device according to claim 1 including a differentiating stage and wherein said repetition stopper is adapted to provide as an acceleration detecting stage a positive feedback for said differentiating stage.

5. A device according to claim 1 including means for providing a delay signal and a switching suppressor for blanking out an acceleration signal in response to a delay signal from said delay signal producing means.

6. A device according to claim 5 wherein an output of said delay means is coupled to said repetition stopper and said blocking stage.

7. A device according to claim 1 including a start control stage coupled to said acceleration detecting stage and with the following stages and means for suppressing an acceleration signal at least during the immediate startup operation.

8. A device according to claim 1 including two timing elements for providing a temperature-dependent and for a temperature-independent intermediate injection step.

9. A device according to claim 1 wherein said AND gate is responsive to inverted inputs from said switching suppressor and from a start signal generator.

10. A device according to claim 1 wherein said AND gate is responsive to inverted inputs from said switching suppressor and from a start signal generator and wherein an output of said delay means is coupled to said repetition stopper and said blocking stage.

* * * * *